US009376303B2

(12) United States Patent
Chadwell et al.

(10) Patent No.: US 9,376,303 B2
(45) Date of Patent: Jun. 28, 2016

(54) TEMPERATURE-CONTROLLED BEVERAGE DISPENSER

(75) Inventors: Joseph Chadwell, San Antonio, TX (US); James Cleland, Cypress, CA (US); William Edwards, Selma, TX (US); Michael Romanszyn, San Antonio, TX (US); James Chaput, Austin, TX (US)

(73) Assignee: Cleland Sales Corp., Los Alamitos, CA (US)

( * ) Notice: Subject to any disclaimer, the term of this patent is extended or adjusted under 35 U.S.C. 154(b) by 1361 days.

(21) Appl. No.: 13/044,514

(22) Filed: Mar. 9, 2011
(Under 37 CFR 1.47)

(65) Prior Publication Data

US 2011/0289947 A1 Dec. 1, 2011

Related U.S. Application Data

(60) Provisional application No. 61/312,089, filed on Mar. 9, 2010.

(51) Int. Cl.

| | |
|---|---|
| ***F25B 1/00*** | (2006.01) |
| ***F25B 41/00*** | (2006.01) |
| ***F25B 41/04*** | (2006.01) |
| ***B67D 1/00*** | (2006.01) |

(Continued)

(52) U.S. Cl.
CPC ..... *B67D 1/0862* (2013.01); *B67D 1/0884* (2013.01); *B67D 1/1272* (2013.01); *F25D 31/002* (2013.01)

(58) Field of Classification Search
CPC ... B67D 1/0862; B67D 1/0884; B67D 1/1272
USPC ..... 62/174, 215, 216, 228.6, 115, 222; 700/282; 222/52
See application file for complete search history.

(56) References Cited

U.S. PATENT DOCUMENTS

| | | | |
|---|---|---|---|
| 1,627,147 | A | 5/1927 | Clark |
| 1,947,329 | A | 2/1934 | Buttner |

(Continued)

FOREIGN PATENT DOCUMENTS

| | | |
|---|---|---|
| GB | 1 300 072 | 12/1972 |
| WO | WO 02/090241 | 11/2002 |

(Continued)

OTHER PUBLICATIONS

Wunder-Bar Food & Beverage Dispensing Systems, Post-Mix Beverage Dispenser, Automatic Bar Controls, Inc., Rev. 120508.

*Primary Examiner* — Henry Crenshaw
(74) *Attorney, Agent, or Firm* — Fish & Tsang LLP

(57) ABSTRACT

A temperature-controlled beverage dispenser is disclosed, which provides a cold plate having disposed therein beverage lines and refrigerant lines. The refrigerant lines may be connected to a cooling system, such as a heat exchanger, which is configured to remove heat from the cold plate. The beverage lines may be connected to a beverage supply for dispensing a desired beverage. Valves and a pressure sensor in the refrigerant line are connected to a microprocessor. At regular intervals, the microprocessor closes the valves, waits a short time, and then takes a pressure reading, which corresponds to a temperature. If the temperature falls below a desired value, then the cooling system is shut off. This permits the microprocessor to closely control the temperature of the beverage being dispensed.

12 Claims, 10 Drawing Sheets

(51) Int. Cl.

| | |
|---|---|
| ***G05D 7/00*** | (2006.01) |
| ***B67D 1/08*** | (2006.01) |
| ***B67D 1/12*** | (2006.01) |
| ***F25D 31/00*** | (2006.01) |

(56) References Cited

U.S. PATENT DOCUMENTS

| | | | | |
|---|---|---|---|---|
| 2,478,586 | A | 8/1949 | Krapp | |
| 2,682,386 | A | 6/1954 | Lindsay | |
| 2,887,250 | A | 5/1959 | Zilk | |
| 2,937,792 | A | 5/1960 | Firstenberg | |
| 3,009,653 | A | 11/1961 | Hedeman | |
| 3,013,701 | A | 12/1961 | Joschko | |
| 3,108,779 | A | 10/1963 | Anderson | |
| 3,326,520 | A | 6/1967 | Guenther | |
| 3,619,668 | A | 11/1971 | Pinckaers | |
| 3,643,754 | A | 2/1972 | Brandin et al. | |
| 3,867,962 | A | 2/1975 | Gerrard | |
| 3,963,317 | A | 6/1976 | Eigenbrode et al. | |
| 4,098,295 | A | 7/1978 | Haytayan | |
| 4,196,886 | A | 4/1980 | Murray | |
| 4,219,046 | A | 8/1980 | West et al. | |
| 4,390,224 | A | 6/1983 | Showman et al. | |
| 4,433,795 | A | 2/1984 | Maiefski et al. | |
| 4,469,389 | A | 9/1984 | Grabbe et al. | |
| 4,497,421 | A | 2/1985 | Schilling | |
| 4,519,635 | A | 5/1985 | McMath | |
| 4,619,378 | A | 10/1986 | de Man | |
| 4,633,676 | A * | 1/1987 | Dittell | 62/238.6 |
| 4,635,824 | A | 1/1987 | Gaunt et al. | |
| 4,637,527 | A | 1/1987 | Arrigoni | |
| 4,821,921 | A | 4/1989 | Cartwright et al. | |
| 4,873,837 | A * | 10/1989 | Murray | B60H 1/323 137/528 |
| 4,921,140 | A | 5/1990 | Belcham | |
| D309,232 | S | 7/1990 | Vallyee et al. | |
| 4,986,449 | A | 1/1991 | Vallyee et al. | |
| 5,033,648 | A | 7/1991 | Nakayama et al. | |
| 5,042,692 | A | 8/1991 | Vallyee et al. | |
| 5,305,924 | A | 4/1994 | Groover et al. | |
| 5,524,452 | A | 6/1996 | Hassell et al. | |
| 5,649,431 | A | 7/1997 | Schroeder et al. | |
| 5,873,259 | A | 2/1999 | Spillman | |
| 6,112,946 | A | 9/2000 | Bennett et al. | |
| 6,196,422 | B1 | 3/2001 | Tuyls et al. | |
| 6,260,477 | B1 | 7/2001 | Tuyls et al. | |
| 6,269,973 | B1 | 8/2001 | Bennett et al. | |
| 6,283,155 | B1 | 9/2001 | Vu | |
| 6,322,051 | B1 | 11/2001 | Salmela | |
| 6,328,181 | B1 | 12/2001 | Schroeder et al. | |
| 6,405,897 | B1 | 6/2002 | Jepson et al. | |
| 6,463,753 | B1 | 10/2002 | Haskayne | |
| 6,626,005 | B2 | 9/2003 | Schroeder | |
| 6,644,508 | B2 | 11/2003 | Haskayne | |
| 6,672,849 | B1 | 1/2004 | Martindale et al. | |
| 6,698,229 | B2 | 3/2004 | Renken | |
| 6,722,527 | B1 | 4/2004 | Krauss | |
| 6,725,687 | B2 | 4/2004 | McCann et al. | |
| 6,761,036 | B2 | 7/2004 | Teague | |
| 6,832,487 | B1 | 12/2004 | Baker | |
| 6,945,070 | B1 | 9/2005 | Jablonski | |
| 7,025,230 | B1 | 4/2006 | Salmela | |
| 7,048,148 | B2 | 5/2006 | Roekens | |
| 7,080,937 | B1 | 7/2006 | Salmela et al. | |
| 7,232,044 | B1 | 6/2007 | Salmela | |
| 7,237,390 | B1 * | 7/2007 | Nelson | 62/3.64 |
| D549,021 | S | 8/2007 | Tuyls et al. | |
| 7,266,974 | B2 | 9/2007 | Schroeder | |
| 7,296,428 | B2 * | 11/2007 | Cleland | 62/196.1 |
| 7,305,847 | B2 | 12/2007 | Wolski | |
| 7,337,618 | B2 | 3/2008 | Wolski | |
| 7,337,627 | B2 | 3/2008 | Wolski | |
| 7,373,784 | B2 | 5/2008 | Haskayne | |
| 7,384,073 | B1 | 6/2008 | Tuyls et al. | |
| 7,448,418 | B1 | 11/2008 | Tuyls | |
| 7,762,431 | B1 | 7/2010 | Tuyls et al. | |
| D626,373 | S | 11/2010 | Valiyee et al. | |
| D626,374 | S | 11/2010 | Valiyee et al. | |
| D626,375 | S | 11/2010 | Valiyee et al. | |
| D628,014 | S | 11/2010 | Martindale | |
| 7,931,382 | B2 | 4/2011 | Hecht | |
| D638,659 | S | 5/2011 | Martindale et al. | |
| D643,708 | S | 8/2011 | Hecht | |
| D647,785 | S | 11/2011 | Hecht | |
| D648,420 | S | 11/2011 | Hecht | |
| D648,421 | S | 11/2011 | Hecht | |
| D648,617 | S | 11/2011 | Hecht | |
| D648,826 | S | 11/2011 | Hecht | |
| 2001/0030308 | A1 | 10/2001 | Schroeder | |
| 2002/0023448 | A1 * | 2/2002 | Ito et al. | 62/222 |
| 2003/0071060 | A1 | 4/2003 | Haskayne | |
| 2004/0210419 | A1 * | 10/2004 | Wiebe et al. | 702/182 |
| 2006/0162370 | A1 | 7/2006 | Haskayne | |
| 2007/0245766 | A1 * | 10/2007 | Younkle et al. | 62/393 |
| 2008/0006050 | A1 * | 1/2008 | Gist et al. | 62/354 |
| 2008/0135426 | A1 | 6/2008 | Hecht et al. | |
| 2008/0196415 | A1 * | 8/2008 | Lodge | 62/3.64 |
| 2008/0217357 | A1 | 9/2008 | Hecht | |
| 2008/0250810 | A1 * | 10/2008 | Chen | 62/396 |
| 2008/0282724 | A1 * | 11/2008 | Minard et al. | 62/389 |
| 2009/0078722 | A1 | 3/2009 | Salmela | |
| 2009/0090747 | A1 | 4/2009 | Tuyls et al. | |
| 2009/0145927 | A1 | 6/2009 | Salmela et al. | |
| 2009/0230148 | A1 | 9/2009 | Valiyee et al. | |
| 2010/0097881 | A1 | 4/2010 | Tuyls et al. | |
| 2010/0116842 | A1 | 5/2010 | Hecht et al. | |
| 2010/0147886 | A1 | 6/2010 | Martindale | |
| 2010/0314411 | A1 | 12/2010 | Tuyls et al. | |
| 2011/0057134 | A1 | 3/2011 | Martindale et al. | |
| 2011/0073617 | A1 | 3/2011 | Martindale et al. | |
| 2011/0286883 | A1 | 11/2011 | Hecht et al. | |
| 2011/0315711 | A1 | 12/2011 | Hecht et al. | |

FOREIGN PATENT DOCUMENTS

| | | |
|---|---|---|
| WO | WO 03/024862 | 3/2003 |
| WO | WO 2006/088990 | 8/2006 |
| WO | WO 2009/090429 | 7/2009 |

* cited by examiner

STANDBY MODE MONITORING TS1

STANDBY MODE MONITORING TS1

PUMP DOWM MODE
MONITORING TS1, PT1

TEMPERATURE-CONTROLLED BEVERAGE DISPENSER

CROSS REFERENCE TO RELATED APPLICATIONS

This application claims priority to U.S. provisional application 61/312,089 entitled "Microprocessor-Controlled Multi-Mode Beverage Dispenser," filed Mar. 9, 2010, which is incorporated herein by reference.

BACKGROUND

The device disclosed is related generally to beverage dispensing systems employing a cooling subsystem, more particularly, a self-contained tabletop beverage dispenser incorporating a refrigerant chilled cold plate for cooling a beverage.

When beer (or other beverage) is charged with a gas, such as a carbon dioxide, to move the beer through the various lines, the gas is entrained to dissolve in the fluid and resides in a stable state for temperatures at or below about 30° F. The gas typically does not bubble out of the fluid, but is carried in the fluid and gives a beverage a distinctive effervescence when consumed. However, as the temperature of the beer rises above 30° F., absent increase in pressure on the system, the gas becomes increasingly unstable and begins to bubble or foam out of the flowing beer. Further warming of the beer increases the foaming effect, as the gas bubbles form and propagate downstream. Foaming is further exacerbated by disturbances in the beer, such as the turbulence generated when the beer is dispensed from the dispensing valve. When beer is warmed to 45° F. or more, such as when exposed to normal ambient room temperature, the gas becomes sufficiently unstable and so much foam is generated when it is dispensed that it often cannot be served to patrons. As a result, as waste increases, and profits decrease.

SUMMARY OF THE INVENTION

Figure 1:
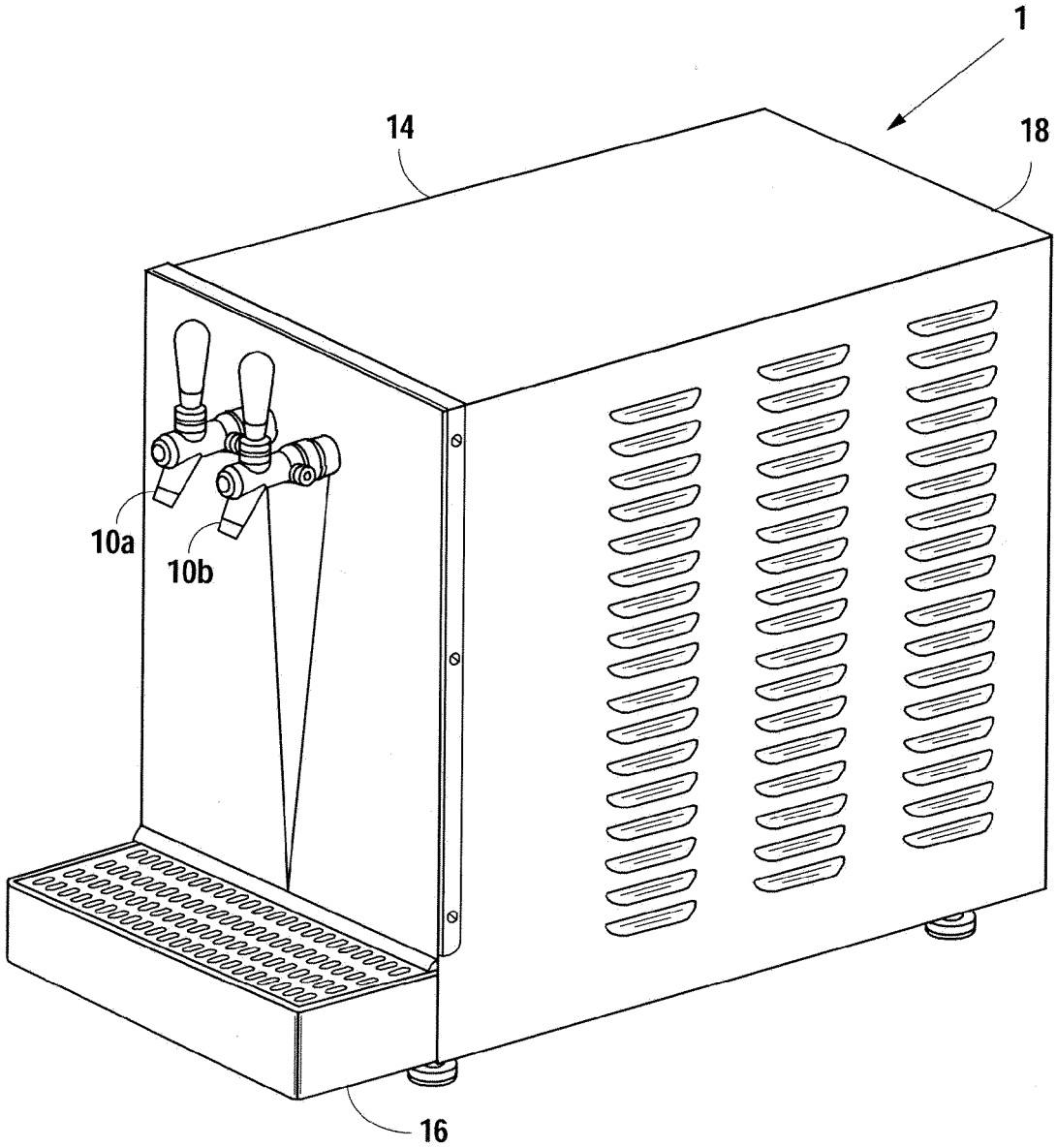
FIG. 1 is a perspective view of the tabletop unit showing the housing, the beverage outlets, and the spill tray.

The present invention is directed to a beverage dispensing system for dispensing chilled beverages, the system comprising a housing with one or more beverage inlet connections extending from said housing and one or more beverage dispenser valves extending from said housing. A beverage cooling system is positioned within said housing, said cooling system comprising a reservoir capable of receiving a supply of refrigerant, a cold plate in fluid communication with said refrigerant reservoir, wherein the refrigerant lines extend through said cold plate, wherein beverage lines also extend through said cold plate adjacent to said refrigerant lines.

The cooling system further includes an accumulator, a compressor, a refrigerant condenser, and a thermal expansion valve positioned between said refrigerant reservoir and said cold plate to adjust the flow of refrigerant depending upon the temperature of the cold plate.

If freeze-up of the beverage in the beverage lines occurs, refrigerant may be controlled by means of a hot gas valve to divert the flow of refrigerant from the cold plate, adding hot gas from the high side of the compressor to the cold plate refrigerant inlet line.

A beer or beverage evaporator valve, typically a solenoid, is provided upstream of the accumulator and downstream of the cold plate. A liquid line valve is provided typically downstream of the condenser and upstream of the reservoir, also solenoid controlled. A thermal expansion valve is provided downstream of the reservoir upstream of and close to the refrigerant inlet of the cold plate, for metering refrigerant into the cold plate in response to a thermal bulb at the outlet of the refrigerant lines on the cold plate.

Electronic sensors, such as transducers (including thermal or pressure sensors), may be provided in conjunction with a microprocessor to control the operation of the system. In one embodiment, a temperature sensor (such as a thermistor) or pressure transducer is located upstream of the evaporator valve and a pressure transducer is located near the suction or low side of the compressor. When the system is energized, that is, in a "run" or "on" mode, the microprocessor will control the compressor. The microprocessor, responsive to the evaporator (cold plate) condition, will initiate a system shutoff when a predetermined psi, for example approximately 55 psi, is reached. The first step of the system shutoff will be to de-energize the normally closed beer evaporator and liquid line valves (thus closing them), thus "trapping" the refrigerant between the valves and in the evaporator and begin monitoring of the sensor at the low end of the compressor or suction side, continuing the compressor running until a predetermined pressure, for example about 10-35 psi, is sensed (thereby assuring the accumulator is void of liquid). At a compressor low end of 10-35 psi, the compressor de-energizes and the system will wait again for a signal from the transducer just downstream from the evaporator. When this transducer hits 70 psi or the associated temperature, the microprocessor will initiate an "on" command to the compressor will be turned on and the solenoids will be energized and opened.

Restated, the microprocessor, in response to a high set point (cold plate too warm) from the first transducer (just upstream of the beer evaporator valve and downstream of the cold plate), will energize the compressor and open the liquid line valve and the evaporator valve, and responsive to an intermediate set point (cold plate low temperature) from the first transducer will close the liquid line valve and evaporator valve, but keep the compressor going, and in response to a low set point from the second transducer (accumulator dry), de-energizes the compressor and goes back to begin the cycle, monitoring the first transducer for the high set point.

There are three modes of operation of the microprocessor/controller ("microprocessor"). The microprocessor has inputs from the first transducer TS1 and the second transducer PT1. The function of the microprocessor is to keep the cold plate temperature between acceptable highs and acceptable lows, or in what may be referred to as a preferred temperature range. This may be found in Table 1, wherein nine such ranges (and a test mode) are providing for setting the microprocessor. For example, certain of these ranges may be more appropriate for beer and others may be more appropriate for soda and still other ranges of the nine set forth in Table 1 may be appropriate for water. Note that the TS1 range, which correlates to temperature range of the cold plate (evaporator), is a spread of about 2.5 psi between ON and OFF for the compressor setting.

A second function of the microprocessor program and control is to, upon compressor shutdown, draw down the low side to avoid liquid accumulation in the accumulator and slugging of the compressor when the compressor restarts, as set forth above.

A third function of the microprocessor controller program is to avoid excessive cycling of the compressor between the on-off mode. This is achieved by an adjusted reading (vaves closed) of the cold plate and maintaining the system in either standby, a compressor mode or pump down mode.

DETAILED DESCRIPTION OF THE EMBODIMENTS self-contained beverage dispenser 10 of the present invention is shown in FIG. 1. Although the subject invention will be described in the context of the beverage to be dispensing being beer, it is to be understood the invention is not limited to the dispensing of beer. Beverage dispensing valves 10*a* and 10*b* stand out the front end of housing 14. The beverage dispensing outlets may be beer taps or other such dispensers as those known in the art. A beverage spill tray 16 is positioned beneath the outlets 10*a* and 10*b*. Beverage dispenser 1 may be mounted on a countertop, rolling cart or other support surface. The beverage dispenser 1 may be easily installed at a desired location. One need simply to run the product lines from the beverage supply, for example, a beer keg, to the location for connection to the beverage dispensing unit.

Figure 2:
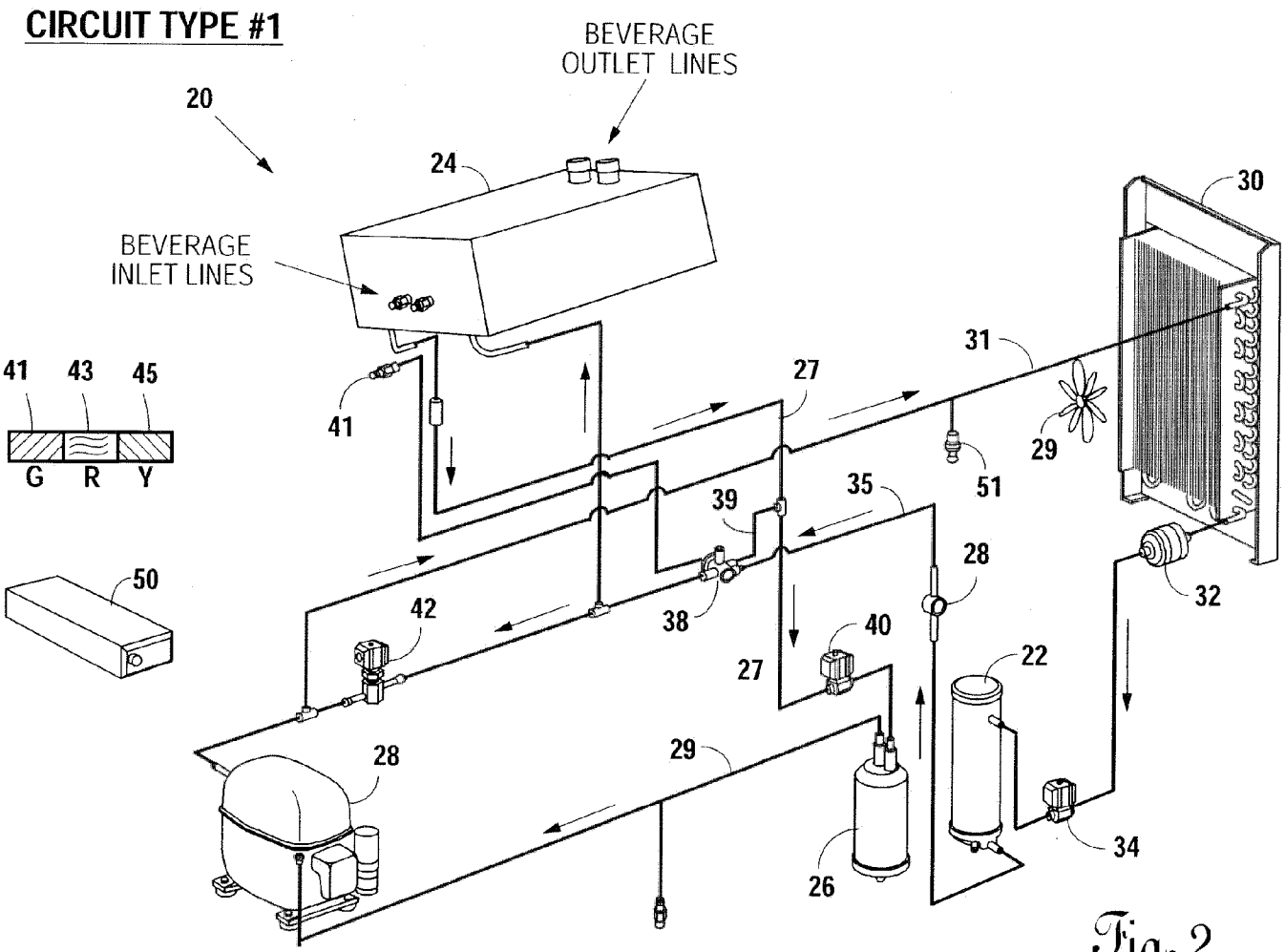
FIG. 2 is an equipment layout, not to scale, showing the relative positions of the elements of Applicants' novel beer cooling system.

The refrigerant cooling system 20 of the subject invention is shown in FIG. 2. The cooling system 20 includes reservoir 22 which acts as the reservoir for the refrigerant, which is in fluid communication with cold plate 24 via refrigerant line 25. Refrigerant cooling lines acting as an evaporator, extend through cold plate 24 to cool corresponding beverage lines which also extend through cold plate 24. The cold plate utilized, including, for example, 40 pounds of cast aluminum, is a standard cold plate known to those skilled in the art wherein the beverage and refrigerant lines may be wound or located within the cold plate to increase the length of the lines positioned within said cold plate. The cooling system 20 also includes accumulator 26, compressor 28 and refrigerant condenser 30. As shown, refrigerant exits the cold plate 24 and flows to accumulator 26 via refrigerant line 27. From the accumulator 26, the refrigerant travels to the compressor 28 via refrigerant line 29. The refrigerant flows from the compressor 28 to the condenser 30 via refrigerant line 31.

The operation of the refrigerant system is described below, in connection with FIGS. 2 and 3.

The refrigerant, which in a preferred embodiment is type 404a, enters the compressor 28 at point A as a low pressure gas and is discharged from the compressor as a high pressure gas at point B. It then enters the top of the condenser 30 at point C.

The refrigerant is cooled in the condenser, exiting it as a high pressure liquid, and passes through a drier 32 (which retains unwanted scale, dirt and moisture) to the liquid line valve 34, which is open whenever the cold plate 24 is warm enough to require cooling, as determined by a pressure switch Transducer TS 1 (pressure transducer or thermistor, for example).

The refrigerant, still in a high pressure liquid state, flows through the liquid line valve 34 and enters the reservoir tank 22, which serves as a storage or surge tank for the refrigerant at point D.

At point E, the refrigerant exits the reservoir tank, passes through a sight glass 36 (where bubbles will be observed if the system is low on refrigerant) and encounters the thermal expansion valve TXV 38.

A pressure differential is provided across the thermal expansion valve. This valve includes a sensor bulb that measures the degree (or lack) of superheat of the suction gas exiting the cold plate and expands or contracts to allow the flow of refrigerant to be varied according to need. The refrigerant leaving the thermal expansion valve will be in a low pressure liquid or liquid/vapor state when it enters the cold plate.

At the thermal expansion valve 38 there may also be a small equalizer tube 39 connected to the outlet cold plate 24. The equalizer tube 38 helps to equalize the pressure between the inlet and outlet side of the cold plate 24.

After passing through the thermal expansion valve 38, the refrigerant enters the cold plate 24 at point G. As the liquid or liquid/vapor refrigerant enters the cold plate it is subjected to a much lower pressure due to the suction created by the compressor and the pressure drop across the expansion valve. It will also be adjacent warmer beer lines. Thus, the refrigerant tends to expand and evaporate. In doing so, the liquid refrigerant absorbs energy (heat) from beverage lines within the cold plate 24.

The low pressure gas leaving the cold plate 24 encounters the evaporator valve 40, whose function is to trap refrigerant in the cold plate during system shutdown cycle. From the evaporator valve 40, the gas passes into accumulator 26, which help prevent any slugs of liquid refrigerant from passing directly into the compressor, and continues back to the compressor 28. The thermal expansion valve 38 mentioned above is used instead of a capillary tube in order to provide improved response to the cooling needs of the cold plate 24.

Figure 2A:
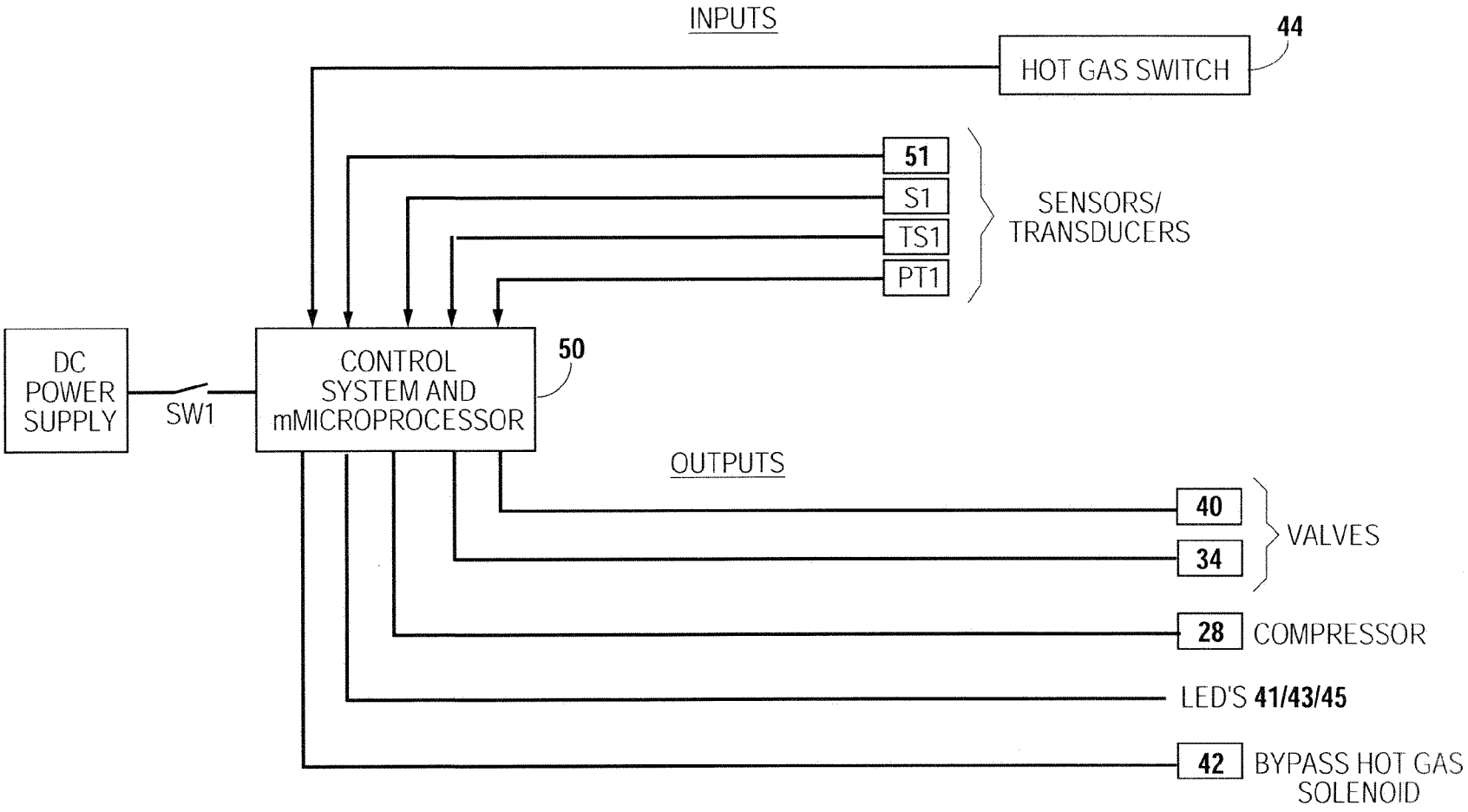
FIG. 2A is a block diagram illustrating the microprocessor inputs and outputs.

The microprocessor controlled electrical control system 50 is illustrated in FIGS. 2 and 2A. Refrigeration on/off switch SW1 provides power to the entire system by manually depressing the switch. Pressure transducer PT1 monitors the refrigerant pressure in the compressor low side and cycles off the compressor and condenser fan (not shown) when the pressure drops to a predetermined level, 15 psi in a preferred embodiment, and cycles the compressor and fan back on when the temperature sensor or pressure transducer TS 1 reaches a second predetermined level, 75 psi in a preferred embodiment. TS 1 monitors refrigerant temperature (or pressure) just downstream of the beverage cold plate. When the pressure drops to a predetermined level, approximately 55 psi in a preferred embodiment, TS 1 through control system 50 cycles off the beverage evaporator coil or cold plate by shutting liquid line solenoid coil 34 and evaporator valve 40. The microprocessor then reads the transducer PT1 until drawdown to a lower pressure than 55 psi is reached, here for example, 10-35 psi, where the compressor is cycled off by the microprocessor/controller. The monitor then looks to TS 1. With the compressor off, the cold plate starts to warm. When the refrigerant pressure at TS 1 rises to a second predetermined level, approximately 72-75 psi in a preferred embodiment, the TS 1 through microprocessor/control system 50 turns on the compressor and opens evaporator solenoid coil 40 and liquid line solenoid 34 A push-button defrost switch 42 is provided to cycle on the hot gas solenoid and cycle off the condenser fan to deliver hot gas to the cold plate should the product in the cold plate become frozen.

Sensor/transducer TS 1 responds to the cold plate 24 temperature by reading the pressure or temperature of the refrigerant as it is discharged from the cold plate. When the cold plate becomes warm enough, the liquid line valve 34 and the evaporator valve 40 open, thereby allowing refrigerant to flow throughout the system. When the cold plate becomes cool enough these valves 34/40 will close, trapping most refrigerant in the system but with the electronic control a] lowing refrigerant to pump from the accumulator into the compressor down until PT1 reads about 15 psi (typically between 10-35 psi).

As shown in FIG. 2, defrost valve 42 is installed between the compressor discharge tube and the cold plate inlet. A manually operated momentary switch 44 may be deployed to trigger the defrost cycle. This signals the microprocessor to open the defrost valve 42 for a preset defrost cycle time, normally 30 seconds, and allows high pressure gas from the compressor to be pumped into the cold plate to thaw it, should it freeze up or get too cold. To prevent damaging the system, the switch should not be held longer than necessary.

The TXV 38 controls and meters the amount of refrigerant that flows into the evaporator based on the temperature with a sensing bulb 41 that is typically located on the suction line where it leaves the evaporator coil. The temperature differential of the evaporator inlet and outlet typically determines the opening and closing of the TXV 38 valve seat to either add refrigerant or constrict refrigerant flow to the evaporator. Other devices known in the art may control pressure of refrigerant into the evaporator.

An electronic microprocessor/controller 50 operates the compressor, condenser fan, and solenoids 34/40. The microprocessor controller engages a power off switch, a defrost switch 42, temperature sensor (from evaporator thermal sensor, a temperature sensor or pressure transducer) TS 1, and an overheat temperature sensor 51 (from high side of condenser), as well as a pressure/transducer PT1 just upstream of the low end of the compressor.

Outputs (110 volt AC) include normally closed solenoids (2) 34/40, the compressor (typically about one-third horsepower) and the condenser fan (typically about 14 watt). Defrost solenoid 42 and a power on and defrost cycle LED include controller outputs.

In the on/run mode (when the power switch is activated), the compressor, condenser fan, and solenoid pair 34/40 are activated. Compressor pumps refrigerant and the temperature of the cold plate will drop as the refrigerant goes through the cold plate. The "power on" LED is on. The monitor is looking at TS 1 looking for the solenoid valves shutoff condition, the intermediate set point here, for example, about 55 psi.

"Stop" mode occurs when the intermediate set point evaporator temperature sensor TS 1 is reached, for example, approximately 29° F. (68.0 psi with Suva® 404A). The solenoids 34/40 are closed trapping liquid refrigerant in the cold plate and reservoir. The condenser fan and compressor continue to run until the pressure/vacuum transducer PT1 set point is reached. This is about 15 psi. This action assures that there is little or no liquid refrigerant left in the accumulator. At this point, the fan and the compressor turn off and wait for a microprocessor signal from the evaporator temperature sensor TS 1. "Power on" LED remains energized.

When temperature of the evaporator at TS 1 increases to an upper limit, typically about 33° F. (74.0 psi with 404A or other suitable refrigerant), the "on" mode is automatically activated by the controller and cycles the compressor on and the solenoids open.

This illustrates the controller in its normal operating mode. However, if the temperature of the high side thermal sensor 51 exceeds a set point (overheat), the system shuts down the compressor, fan, and solenoids and alternately flashes the LED indicators. This is a warning that the system has overheated.

If the system freezes up or gets too cold, the momentary "defrost" switch is activated. The defrost solenoid is activated and the defrost LED flashes for a defrost cycle. The cycle is timed to last about 15-20 seconds, after which the LED turns off and the dispenser returns to the normal on/run cycle.

One of the purposes of the electronic controller 50 is to maintain the compressor in an off position until the temperature of the evaporator reaches an upper limit, typically about 33° F., and the on mode is activated again. Thus, if there is any liquid refrigerant in the accumulator and it evaporates, as the system warms up or pressure increases, the pressure switch at the low end of the compressor will not cycle the compressor on. That is to say, the microprocessor controller 50 will provide for compressor run/on when solenoids 34/40 are de-energized and closed, but only until PT1 reads about 15 psi or between about 10-35 psi, (thereby ensuring evaporation of any liquid refrigerant in accumulator 26).

Figure 3:
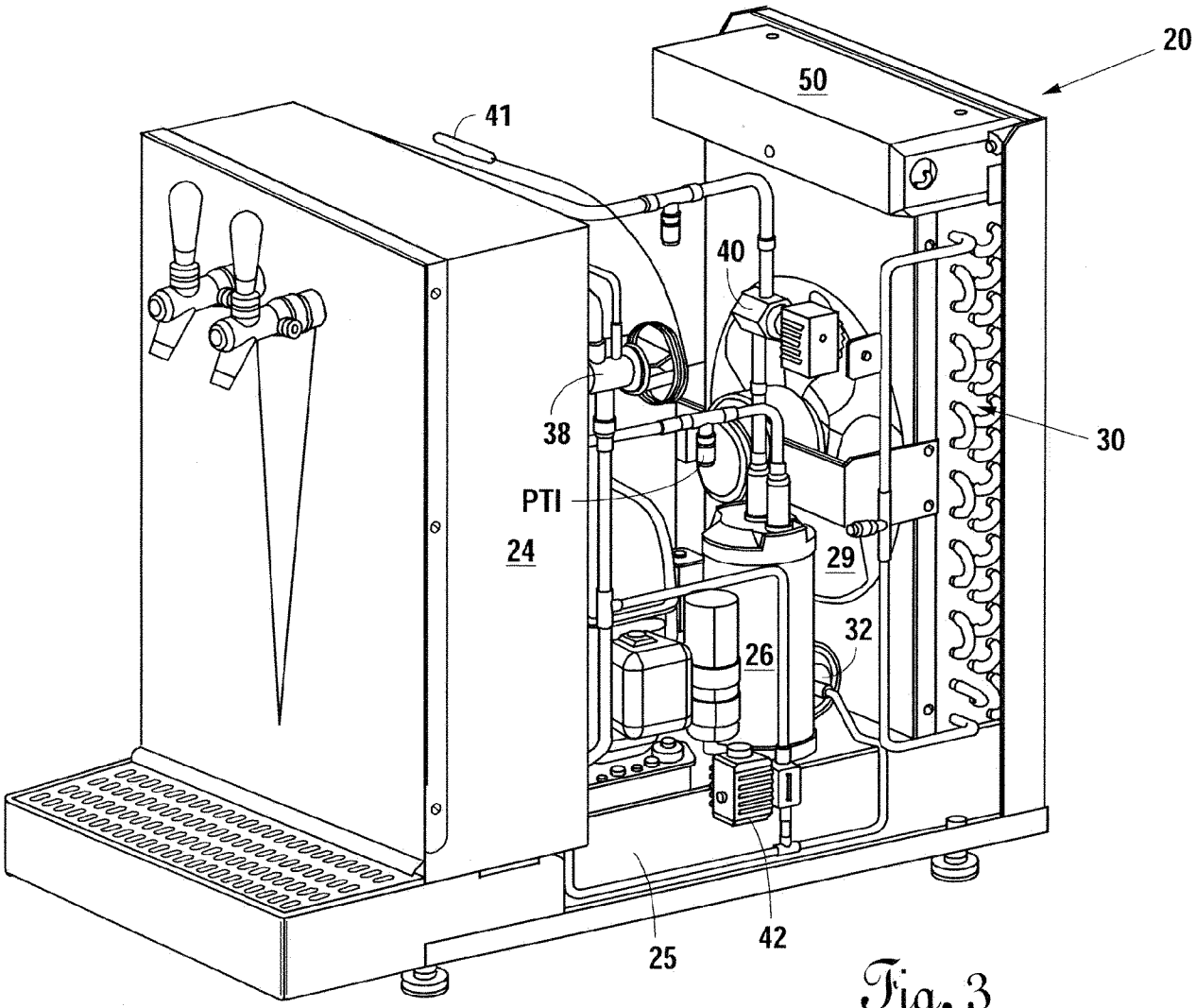
FIGS. 3 and 4 are perspective views of the equipment layout showing the elements of the cooling system in place with the housing cover removed therefrom.
Figure 4:
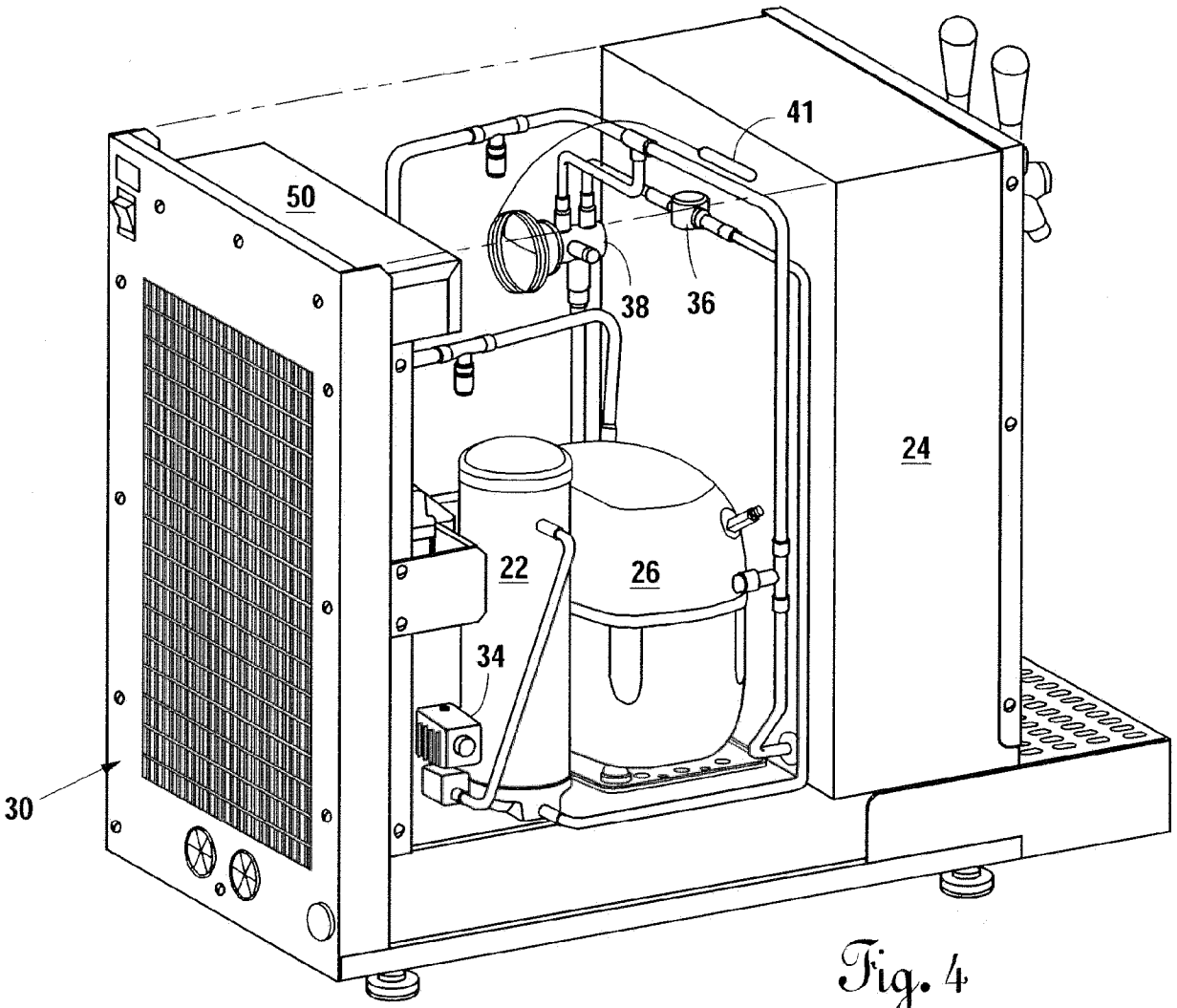

FIGS. 3 and 4 illustrate an equipment layout for the embodiment of Applicants' device as set forth in FIGS. 1 and 2. It is seen with respect to FIGS. 3 and 4, that the cold plate 24 is set vertically with respect to a base 25 of the cooling system 20. Furthermore, it can be seen that the condenser 30 is also set vertically and spaced apart from the cold plate 24. A substantial number of the elements are set between the vertically oriented cold plate and condenser, including the compressor, drier, solenoids, sight glass, liquid line valve, thermal control valve, evaporator valve, reservoir tank, and accumulator. Moreover, the fan for the condenser is mounted inside the unit exhausting air through vents in the rear view of the unit (see FIG. 4).

Figure 5:
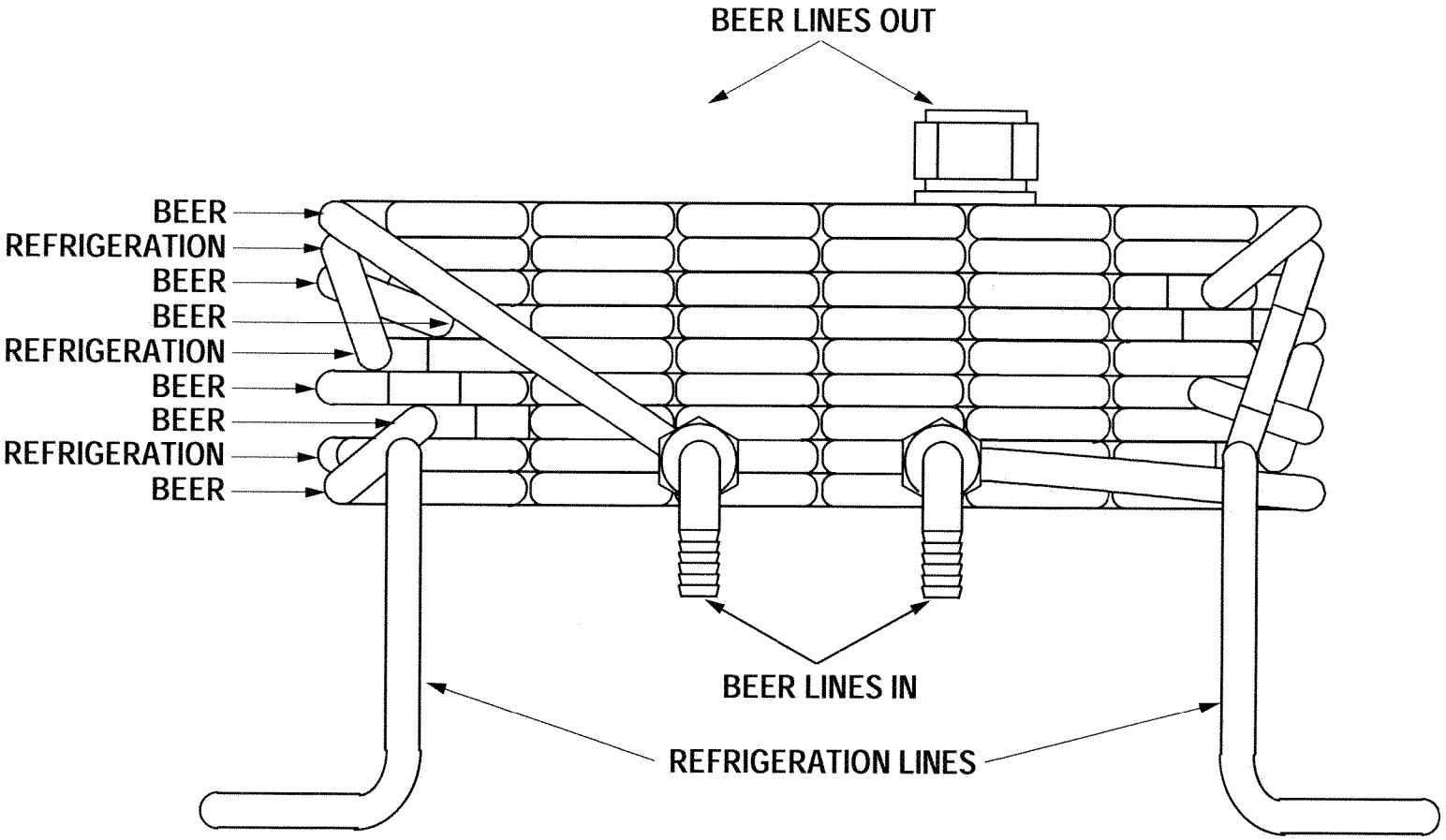
FIG. 5 is an elevational view of the beverage or beer lines and refrigeration lines within the cold plate.
Figure 7:
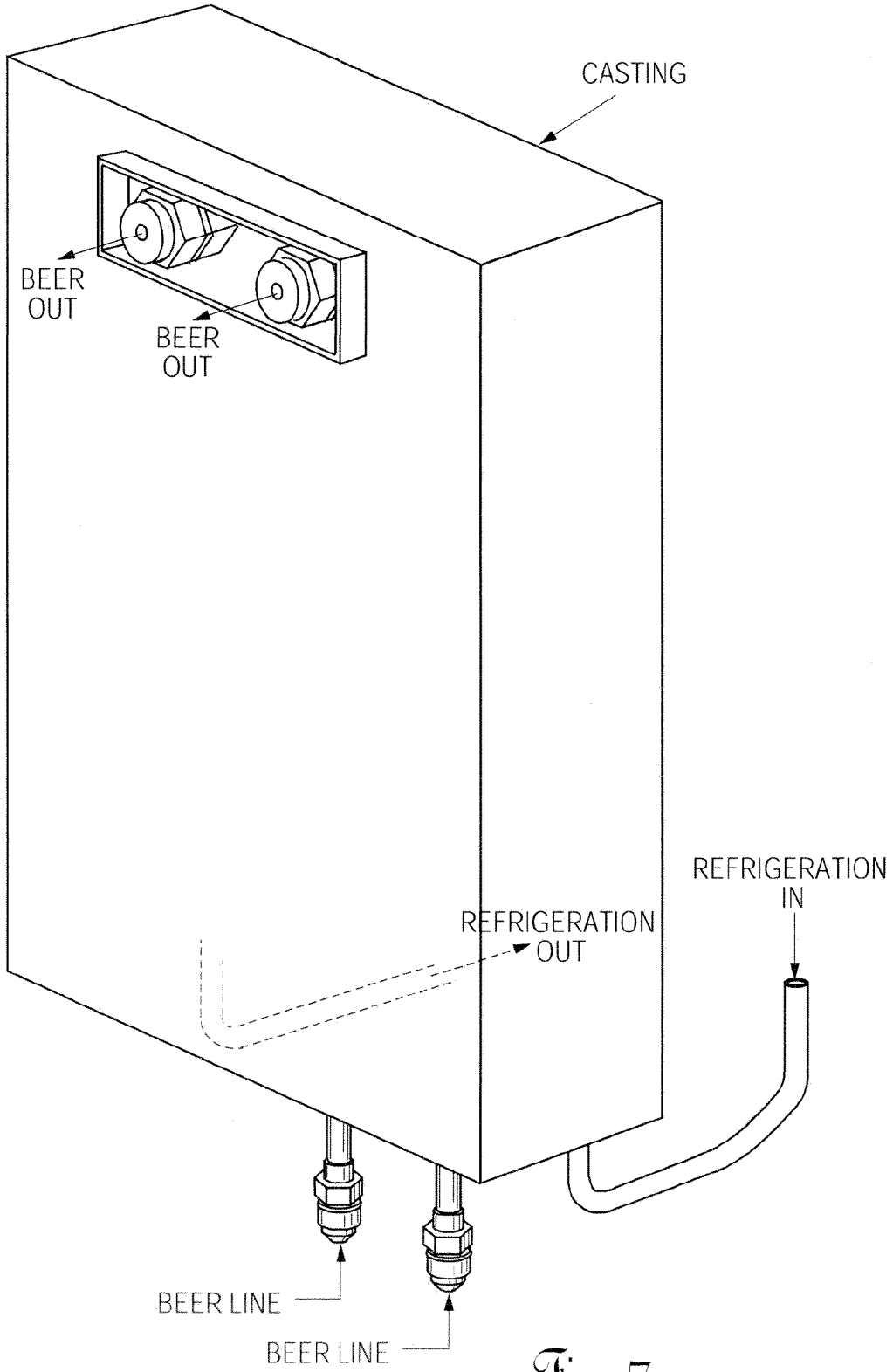
FIG. 7 is a perspective view of the cold plate showing refrigeration lines and beer lines laying adjacent one another and embedded within an aluminum casting.

FIGS. 5 and 7 illustrate an embodiment of an arrangement of refrigeration lines and beer lines that may be used in the cold plate. It is seen with respect to FIG. 5 that refrigeration lines lay in a plane, as do the beverage lines. Adjacent to each beer line plane lays a refrigeration time plane for uniform heat transfer.

Figure 6:
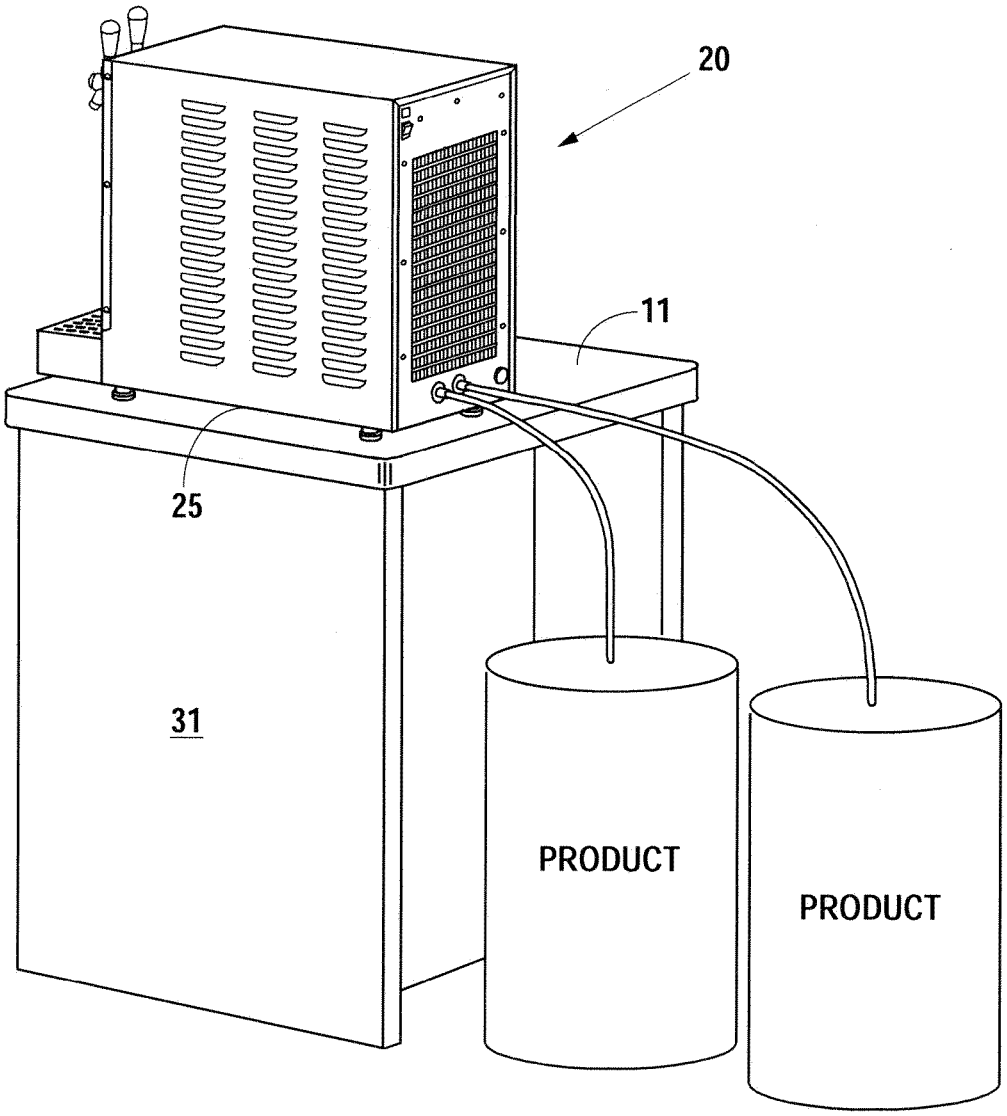
FIG. 6 is a perspective view of a layout for use with Applicants' novel beverage cooling system which shows a tabletop supporting the unit, which tabletop in turn is supported by legs or a cart or the like; the product here, two different beverages, are provided in feed lines to the rear of the housing of the unit.

FIG. 6 illustrates a manner in which Applicants' novel cooling system 20 may be set up on a support surface or a table top TT, wherein the product (beverage) being supplied to the system, here from two kegs or other containers of liquid product, may enter the system from the rear. In an alternate preferred embodiment, the lines from the product to the cooling system may enter the system from beneath the table top TT and beneath the base 25. Another suitable arrangement would be provided on a table top TT with a support member that is in the nature of a cart 31 having wheels (not shown), so that the unit may be wheeled around.

Part of the advantages of the system described is the microprocessor controlled solenoid valves trapping refrigerant responsive to the microprocessor signals as set forth above. Normally on most systems when the system shuts down, the pressure differential will bleed back down to equilibrium, and in a normal situation when the system starts up, there is a time lag to drive up pressure in the condenser as the system starts back up. In the system set forth herein, however, by the action of the solenoid shutdown, pressure is maintained and bleed down is avoided. That is to say, there is a "stop action" freeze of the refrigeration cycle which allows an almost instantaneous return to the refrigeration cycle without the necessity of loading up the condenser.

Operation is driven by readings from two pressure transducers TS 1 (cold plate), PT1 (suction side of compressor). One TS1 measures pressure of gas in the evaporator which reflects the temperature of the cold plate. The other, PT2, measures pressure of the pump down cycle. The firmware controls the compressor 28, fan 29, run solenoids 34/40, defrost solenoid 42, and status LED's 41/43/45 (see Table 1). There is a ten position switch that determines the setpoints for the cold plate temperature. There is a defrost switch for starting a defrost cycle.

The unit operates in one of the following modes depending on the pressure transducer readings.

Figure 8:
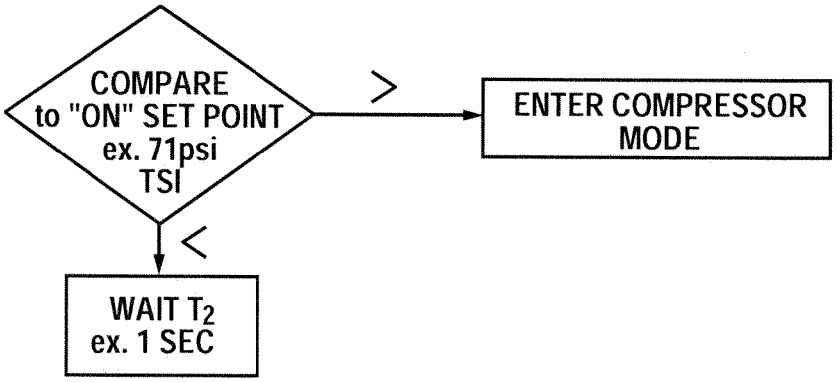
FIG. 8 is a flow chart illustrating the standby mode.

FIG. 8, Standby mode (green LED 41 blinking):

Evaporator pressure indicates cold plate temperature below "on" setpoint.

Run valves 34/40 and defrost solenoid 42 are off (valves closed.) Compressor 20 and fan 28 are off.

When evaporator pressure TS 1 indicates cold plate temperature above "on" setpoint, example 71.0 psi, unit enters compressor mode.

Figure 9:
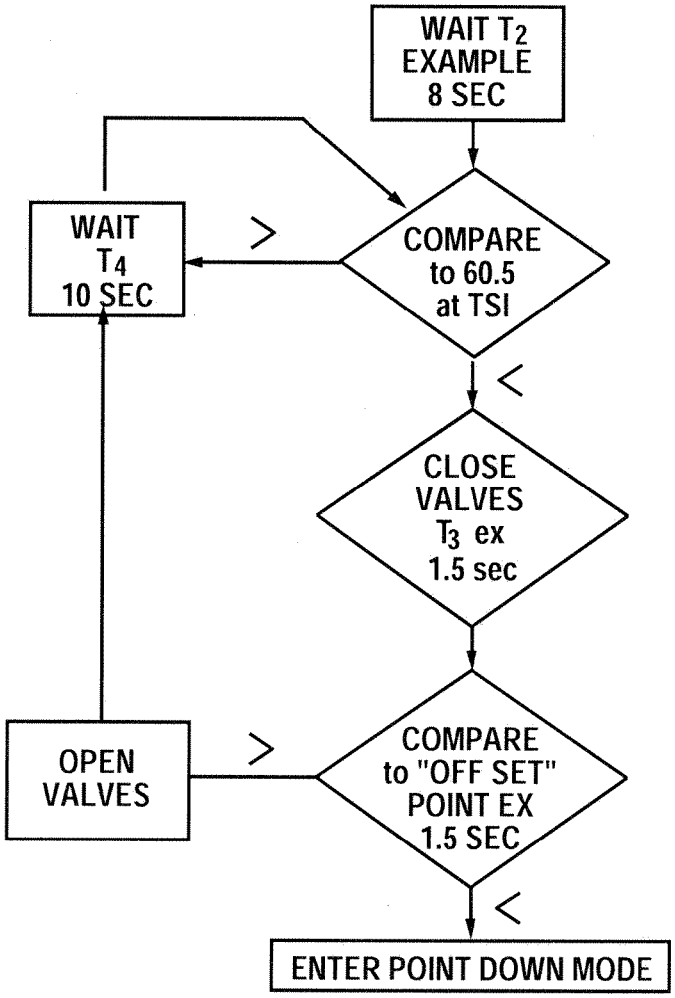
FIG. 9 is a flow chart illustrating the compressor mode.

FIG. 9, Compressor mode (green LED 41 blinking, red LED 43 on steady):

Run solenoids 34/40 are on (valves open) and defrost solenoid 42 is off (valve closed). Compressor 28 and fan 29 are on. Evaporator pressure indicates cold plate temperature above "off" setpoint, example 68.5 psi.

Runs compressor with run valves open, monitors TS1 for a time period T1, every, for example 10 seconds, until evaporator pressure is below 60 or the "off" setpoint, example 68.5 psi, minus 8 (whichever is greater). This pressure reading is done with the run valves open which typically gives a pressure reading of 15 to 20 pounds lower than a reading with the valves closed. Closing the valves, waiting a short period, and then measuring the cold plate gives a more accurate cold plate temperature. The valves closed reading would be one that more accurately reflects the temperature of the cold plate.

After the evaporator pressure TS 1 (with the valves open) gets below 60 (or off set point minus 8), the unit starts checking the evaporator pressure with the run valves closed for a period of T2, for example, every 10 seconds. It does this by closing the run valves (with the compressor still running), waiting 1.5 seconds for the pressure to stabilize, and then taking a TS1 pressure reading. If the pressure is not below the "off" setpoint, the valves are reopened and the unit stays in compressor mode. Otherwise the unit enters pump down mode with the valve 34/40 closed.

Figure 10:
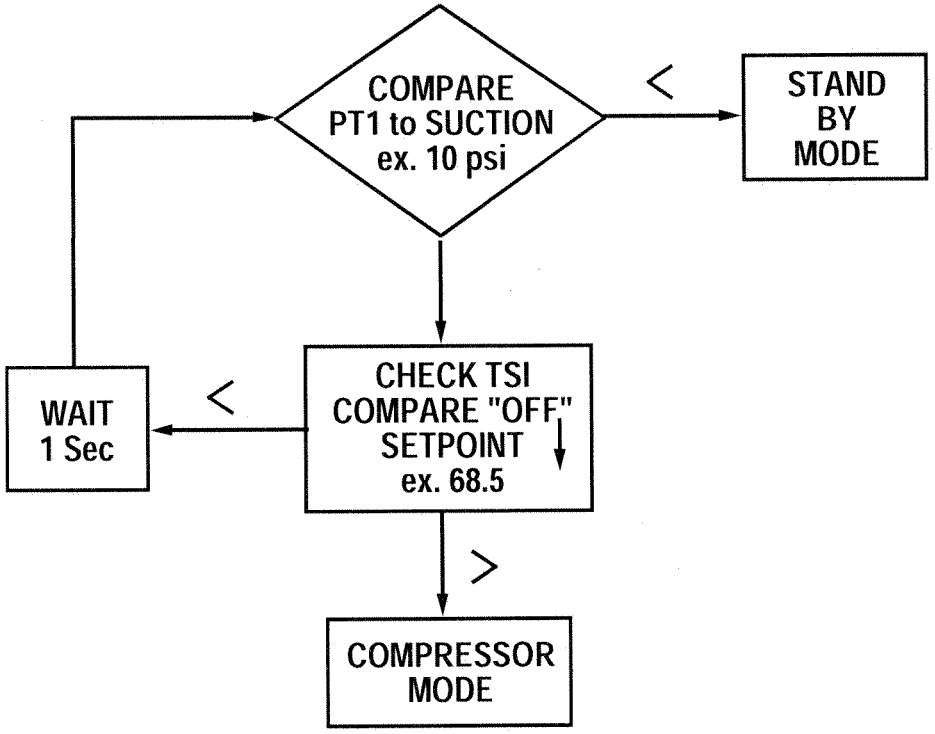
FIG. 10 is a flow chart illustrating the pump down mode.

FIG. 10, Pump down mode (green LED blinking, red and yellow LED's on):

Pump down pressure above 10 as measured at PT1. Run solenoids 34/40 are off (valves closed) and defrost solenoid is off (valve closed). Compressor 28 and fan 29 are on.

Remains in pump down mode until pump down pressure PT1 is below 10 or evaporator pressure TS 1 is above "on" setpoint. If the pump down pressure reaches 10, the unit enters standby mode. If the evaporator pressure goes above the "on" setpoint, the unit enters compressor mode.

Defrost mode (green LED blinking, yellow LED on):

Defrost mode is entered when the defrost switch is manually pressed.

Run solenoids 34/40 are on (valves opened) and defrost solenoid 42 is on (valve open). Compressor 28 is on and fan 29 is off. Defrost mode runs for a period of T3, for example, for 40 seconds then standby mode is entered. Defrost mode cannot be reentered until a compressor mode cycle has completed.

TABLE 1

| | Setpoints | | | |
|---|---|---|---|---|
| | On | Off | Temp On | Temp Off |
| 1 | 65 | 62.5 | 27.1 | 25.5 |
| 2 | 67 | 64.5 | 28.4 | 26.8 |
| 3 | 69 | 66.5 | 29.7 | 28.1 |
| 4 | 71 | 68.5 | 31.0 | 29.4 |
| 5 | 73 | 70.5 | 32.3 | 30.7 |
| 6 | 75 | 72.5 | 33.6 | 32.0 |
| 7 | 77 | 74.5 | 34.9 | 33.3 |
| 8 | 79 | 76.5 | 36.2 | 34.6 |
| 9 | 81 | 78.5 | 37.5 | 35.9 |

TABLE 2

| | Temperature | Pressure |
|---|---|---|
| LOW | 28 | 68 |
| HIGH | 36 | 78 |
| Diff | 8 | 12 |
| | Pressure Diff per degree | 1.53 |

T1 (see FIG. 8) is a period of time in which the system is in a standby mode which was entered after the cold plate was sufficiently cold and the low end PT1 pressure was below a preset minimum, for example, 10 psi. The system, left in the standby mode, would typically warm up, for example, towards room temperature or when a beer is drawn from adding heat to the cold plate. Thus in standby mode, the cold plate is being monitored for a period of time T1. This period should be short enough to be responsive to temperature change at the cold plate, for example, drawing a beer. It should not be too short generating unnecessary monitoring.

Time period T2 is a time period between leaving standby mode, when the on set point is exceeded and entering compressor mode. That is, time period T2 should not be too long, as the system needs heat removed therefrom.

In compressor mode, the microprocessor (monitor) is looking at the cold plate temperature and comparing it to a preselected temperature of either 60 psi or the compressor off temperature −8 psi or an appropriate value below the off set point. It has been determined, through experimentation, that a more accurate reading of the cold plate occurs if run valves 34/40 are closed for a period of time, for example, T3, here 1.5 seconds, after which period of time the cold plate is monitored. If, in the compressor mode, the closed valve reading is below the off set point, here, for example, 68.5, then the system will enter the pump down mode. If the closed valve reading is greater than the off set point, the valves will open and the time period, for example, T4 will be applied and then the cold plate pressure will again be checked. For a time period, T3 experimentation can determine as short a time as possible for pressure in the cold plate to stabilize. For a period of time T4 is not too long or the off set point here, for example, 68.5, may be overshot. If T4 is too short, you are hurting your cooling capacity by having the valves closed again for T3.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

What is claimed is:

1. A method of controlling temperature in a cooling system having a compressor, a cold plate, and a refrigerant supply line, the method comprising the steps of:

i) activating the cooling system;

ii) restricting flow of the refrigerant in the refrigerant supply line;

iii) waiting a first time span until a refrigerant pressure is stabilized;

iv) measuring the refrigerant pressure at a cold plate while leaving the cooling system operational;

v) unrestricting flow of the refrigerant in the refrigerant supply line;

repeating steps of ii) to v) sequentially and periodically; and vi) if the refrigerant pressure is lower than a first predetermined pressure, then restricting flow of the refrigerant in the refrigerant supply line and waiting a second time span while the compressor is operating.

2. The method of claim 1 wherein:

restricting the flow of the refrigerant in the refrigerant supply line comprises closing a first valve at a supply end of the refrigerant supply line and closing a second valve at a return end of the refrigerant supply line; and unrestricting the flow of the refrigerant in the refrigerant supply line comprises opening the first valve and the second valve.

3. The method of claim 1 wherein the first predetermined pressure is between 60 psi and 70 psi.

4. The method of claim 3 wherein the steps iii) to v) are repeated every ten seconds.

5. The method of claim 1 wherein the steps of iii) to v) are repeated every five seconds.

6. The method of claim 1 wherein the first time span is selected to be long enough to permit the pressure in the refrigerant supply line to approach a steady-state value.

7. The method of claim 6 wherein the first time span is between one second and four seconds.

8. The method of claim 1 wherein the first time span is between 0.5 second and 3 seconds.

9. The method of claim 1 further comprising a step of turning off a compressor if the refrigerant pressure is lower than a second predetermined pressure.

10. The method of claim 1 further comprising a step of comparing the refrigerant pressure to a second predetermined pressure, and if the refrigerant pressure is above the second predetermined pressure and if the flow of the refrigerant in the refrigerant supply line is restricted, unrestricting flow of the refrigerant in the refrigerant supply line.

11. The method of claim 1 further comprising a step of continuously monitoring the refrigerant pressure before step ii), wherein the step ii) begins only after the refrigerant pressure has dropped below a monitoring threshold.

12. The method of claim 11 wherein the monitoring threshold is approximately 62 psi.

* * * * *